US005265879A

United States Patent [19]

Garcon et al.

[11] Patent Number: 5,265,879

[45] Date of Patent: Nov. 30, 1993

[54] TRAVEL ASSISTANCE GAME

[76] Inventors: Christian Garcon, 1631 Hoaaina Pl., Honolulu, Hi. 96821; Shin Domen, 1711 Kino St., Honolulu, Hi. 96819

[21] Appl. No.: 917,343

[22] Filed: Sep. 28, 1992

[51] Int. Cl.[5] ..... A63F 3/00

[52] U.S. Cl. ..... 273/254

[58] Field of Search ..... 273/243, 248, 249, 251, 273/252, 254

[56] References Cited

U.S. PATENT DOCUMENTS

| | | | |
|---|---|---|---|
| 707,469 | 8/1902 | Wayts | 273/254 |
| 2,178,330 | 10/1939 | Thomas | 273/254 |
| 4,052,071 | 10/1977 | Siegfried | 273/254 |
| 4,109,917 | 8/1978 | Hatcher | 273/254 |
| 4,283,059 | 8/1981 | Beeder | 273/254 |
| 4,787,639 | 11/1988 | Ross | 273/254 X |
| 4,923,198 | 5/1990 | Diaz | 273/254 X |
| 4,961,582 | 10/1990 | Van Lysel | 273/254 |
| 4,988,108 | 1/1991 | Shepard | 273/254 |

FOREIGN PATENT DOCUMENTS

| | | | |
|---|---|---|---|
| 2219744 | 12/1989 | United Kingdom | 273/254 |

*Primary Examiner*—William Stoll

*Attorney, Agent, or Firm*—Michael I. Kroll

[57] ABSTRACT

A travel assistance game is provided which consists of a game board having two concentric continuous paths around its perimeter divided into consecutive playing spaces bearing instructions, some of which represent amounts to be paid and received by each player during the game. A map of the world is at the center of the game board. The map identifies by number and name six different continents. A plurality of first type playing pieces are provided, with one for each player used to be placed onto each continent on the map during the game. A plurality of second type playing pieces are provided with one for each player used to be placed onto each playing space during the game. Play money of different denominations are for distribution of part thereof to each player. A plurality of accident/sickness cards are provided with each to be picked by the players when their respective second type playing piece lands on a playing space bearing instructions to do so. A plurality of travel record sheets are provided in which one is used by each player. A mechanism is for producing by chance a random output count to indicate the number of playing space to be moved by each second type playing piece during the game.

5 Claims, 4 Drawing Sheets (LINED FOR COLOR)

(LINED FOR COLOR)

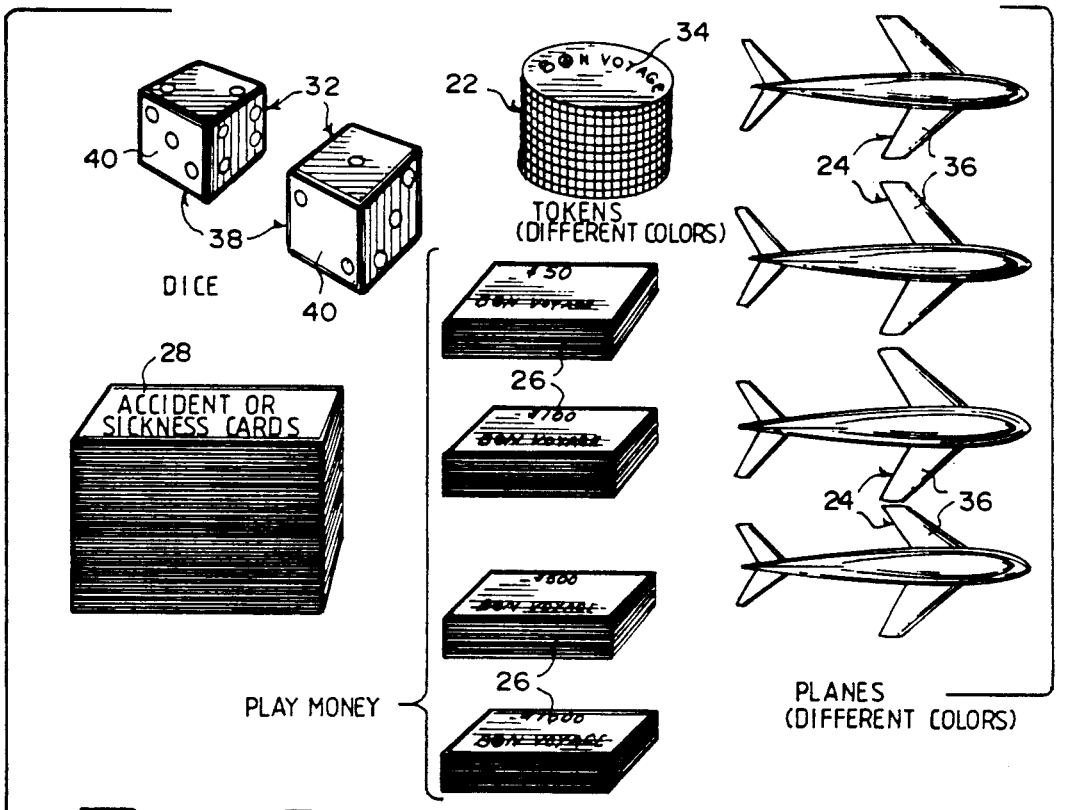

Fig 3

GAME PIECES

30

| BON VOYAGE INSURANCE / ASSISTANCE BENEFITS | | | | |
|---|---|---|---|---|
| PLAYER NAME INSURANCE#1 | | | | |
| TRAVEL SAVING | MEDICAL EXP. | LEGAL ASSIST. | TC, TD, TI | BAGGAGE |
| $12000 | $12000 | $5000 | 2500 | 2500 |

30

| BON VOYAGE INSURANCE/ASSISTANCE BENEFITS | | | | |
|---|---|---|---|---|
| PLAYER NAME INSURANCE#2 | | | | |
| TRAVEL SAVING | MEDICAL EXP. | UNLTD REP. | INTPT MESS. | RSV. INF. |
| $12000 | $12000 | $$$$ | FREE | FREE |

30

| BON VOYAGE |
|---|
| PLAYER NAME NOT INSURED |
| TRAVEL SAVINGS $ 12000 |

Fig 4

(CARD & TRAVEL INSURANCE RECORD SHEETS)

Fig. 3A (REPRESENTATIVE ACCIDENT / SICKNESS CARDS)

| 28 | 28 |
|---|---|
| Your son had a bad case of diarrhea and you took him tosee a doctor (Medical bill = $200 lose a turn. | While shaving your face you accidently sliced a piece of your lip. Ouch! (Medical bill = $300) |
| You neglected to put on your sun screen lotion. You suffered a second degree burn. (Medical bill = $300) | As you were making a right turn you forgot that the country you were visiting drove on the opposite side of the road. "Head-on collision!" You had an operation on your left shoulder. (Medical bill $2000) Lose one turn. |
| You had a major tooth-ache and you went to see a dentist for emmergency care (Dental bill = $350) | Your were playing tennis with your son and the ball hit you right on the "private." You were taken to the hospital for emergency care. (medical bill = $250) |
| Your spouse slipped in the hotel bathroom and hit her head on the edge of the sink. (Medical bill = $200) | Your experienced a minor concusion and a sprained neck from diving into the shallow end of the pool. (Medical bill = $2000) Lose one turn. |
| Your daughter rented a moped and ran into a wild dog. She broke her left shoulder and her right leg. (Medical bill = $2000) Lose one turn. | You went hiking and fell off a 15ft. cliff. You broke your left ankle. (Medical bill = $1500) Lose on turn. |
| While walking to the beach you tripped over a rock and fractured your knee. (Medical bill = $1000) Lose one turn. | You came down with a bad flu and went to see the doctor. (Medical bill = $200) Lose one turn. |

TRAVEL ASSISTANCE GAME

BACKGROUND OF THE INVENTION

1. Field of the Invention

The instant invention relates generally to board games and more specifically it relates to a travel assistance game.

2. Description of the Prior Art

Numerous board games have been provided in prior art that are adapted to entertain the players by challenging them, so that they will utilize their skill and acumen in playing the game. While these units may be suitable for the particular purpose to which they address, they would not be as suitable for the purposes of the present invention as heretofore described.

SUMMARY OF THE INVENTION

A primary object of the present invention is to provide a travel assistance game that will overcome the shortcomings of the prior art devices.

Another object is to provide a travel assistance game in which an element of chance will add a bit of adventure and luck to the game when each player travels around the world on a game board.

An additional object is to provide a travel assistance game which closely simulates true action and excitement of traveling in an airplane around the world through six continents.

A further object is to provide a travel assistance game that is simple and easy to use.

A still further object is to provide a travel assistance game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a perspective view and top plan view of the game pieces.

FIG. 3A is a plan view showing representative accident/sickness cards.

FIG. 4 is a plan view showing representative travel record sheets.

DETAILED DESCRIPTION OF THE PREFERRED EMBODIMENTS

Figure 1:
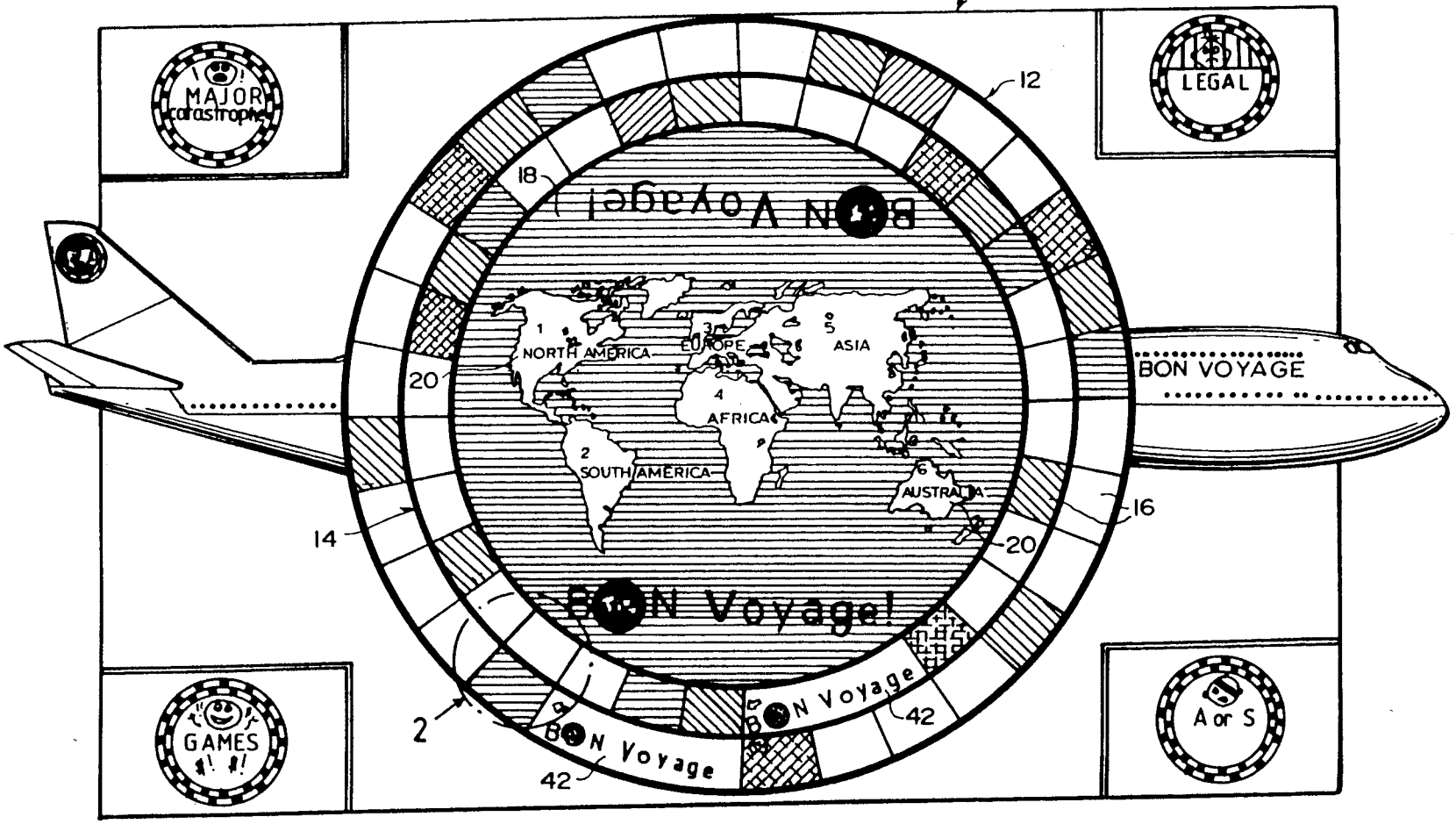
FIG. 1 is a plan view of the game board.
Figure 2:
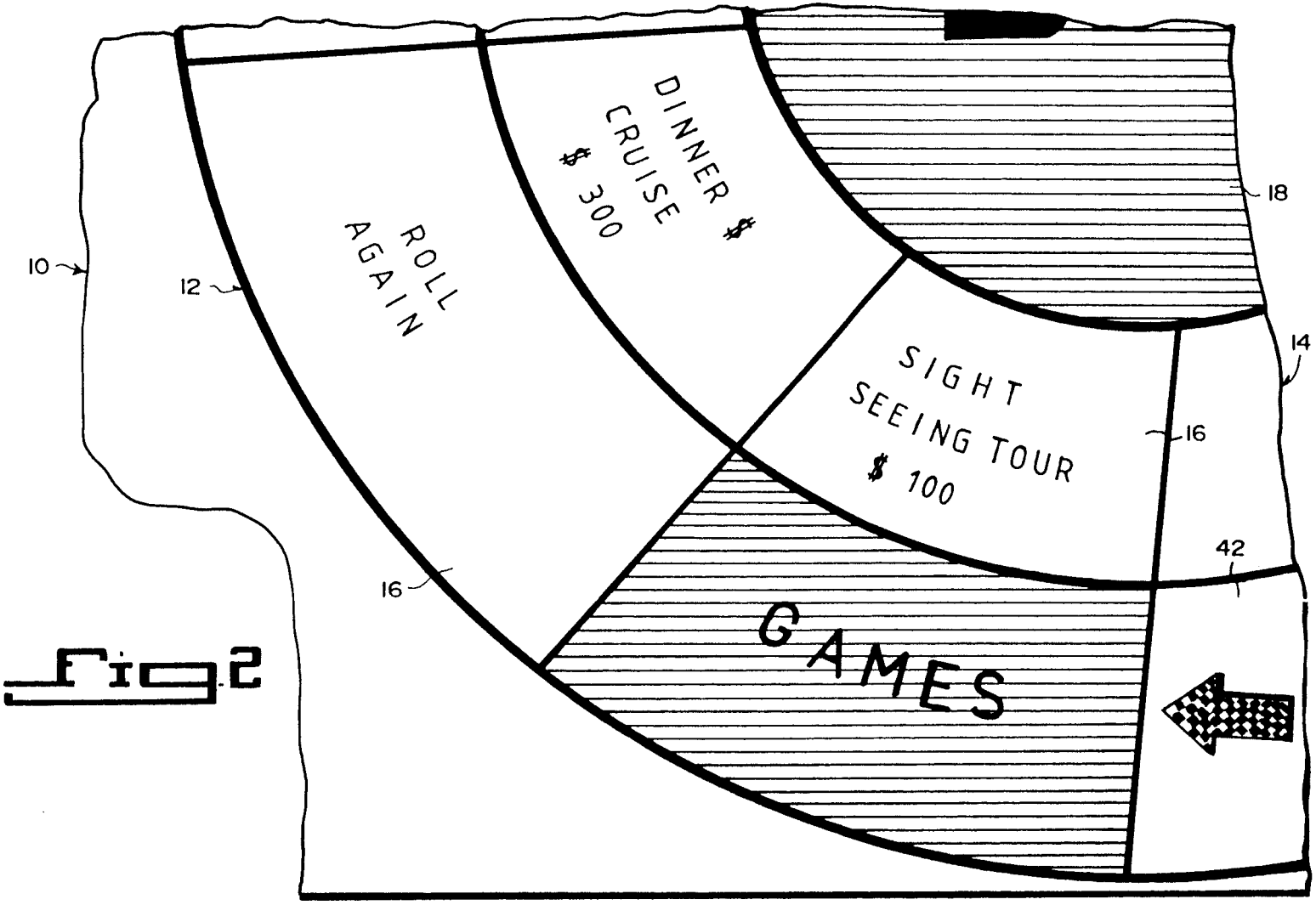
FIG. 2 is an enlarged plan view of a portion of the game board as indicated by arrow 2 in FIG. 1.

Turning now descriptively to the drawings, in which similar reference characters denote similar elements throughout the several views, the Figures illustrate a travel assistance game which consists of a game board 10 having two concentric continuous paths 12 and 14 around its perimeter divided into consecutive playing spaces 16 bearing instructions, some of which represent amounts to be paid and received by each player during the game. A map of the world 18 is at the center of the game board 10. The map 18 identifies by number and name six different continents 20. A plurality of first type playing pieces 22 are provided, with one for each player used to be placed onto each continent 20 on the map 18 during the game. A plurality of second type playing pieces 24 are provided, with one for each player used to be placed onto each playing space 16 during the game. Play money 26 of different denominations are for distribution of part thereof to each player. A plurality of accident/sickness cards 28 are provided, with each to be picked by the players when their respective second type playing piece 24 lands on a playing space 16 bearing instructions to do so. A plurality of travel record sheets 30 are provided, in which one is used by each player. A mechanism 32 is for producing by chance a random output count to indicate the number of playing spaces 16 to be moved by each second type playing piece 24 during the game.

The numbers and names of the six different continents 20 identified on the map of the world 18 are 1 North America, 2 South America, 3 Europe, 4 Africa, 5 Asia and 6 Australia. Each first type playing piece 22 is a token 34 of a particular color. Each second type playing piece 24 is a small airplane 36 of a particular color. Each player uses the token 34 of a particular color that matches with the small airplane 36 of a particular color during the game.

The play money 26 is in denominations of fifty dollars, one hundred dollars, five hundred dollars and one thousand dollars. The accident/sickness cards 28 indicate different medical situations which the players can encounter and the amount of money that must be paid during the game. The travel record sheets 30 are of three different types, in which two are of two different insurance programs and the third is not for an insurance program, whereby each player can choose one type of the travel record sheet 30 when they want to keep a record of their expenses during the game.

The chance producing mechanism 32 contains a plurality of individual gaming pieces 38, wherein the random output count always has a corresponding plurality of digits. The gaming pieces 38 are dice 40, in which the dice 40 are two in number.

Each continuous path 12, 14 on the game board 10 includes twenty nine playing spaces 16 and a start/stop playing space 42 labeled "Bon Voyage!" to indicate one route thereabout. Each player must move their small airplane 36 completely around the two continuous paths 12, 14 being two routes to complete their trip to each continent 20 on the map of the world 18.

RULES OF THE GAME

Objective of the game: The first player to successfully travel around the world through six continents 20, a total of six times around the game board 10 to include the outer continuous path 12 plus the inner continuous path 14 with a minimum of expenses wins.

There are Accident or Sickness (A or S), Legal and Major Catastrophe situations as well as normal travel expenses. You can be assisted by a Travel Insurance/Assistance program, which could potentially save you a lot of money.

Equipment: A game board 10, two dice 40, tokens 34 of different colors, small airplanes 36 of different colors, play money 26, accident/sickness cards 28 and travel record sheets 30.

How to start the game: Each player chooses whether or not to buy an insurance program. This can only be done at the beginning of the game. Also, each player chooses a small airplane 36 and a token 34 of the same color. For example, if you choose a green small airplane 36, you also get a green token 34. The small airplane 36 represents you and your family as you travel around the board. All players will start from North America and then move to South America, Europe, Africa, Asia and Australia. You must go around the game board 10 twice (outer continuous path 12 and inner continuous path 14) to complete each continent 20. You have to go six times (outer continuous path 12 and inner continuous path 14); however, on your final round, you must land on the start/stop playing space 42 (Boy Voyage), to complete your trip unless you are the only remaining player.

After a player has exhausted all of his insurance benefits, he must use his own travel savings to pay for any expenses thereafter. The player needs to keep a record of his expenses using the travel record sheet 30. The player has to move his token 34 from continent to continent after completing one turn (outer continuous path 12 and inner continuous path 14) passing the start/stop playing space 42 (Bon Voyage).

There are two ways that a player can be eliminated from the game:

1. Land on a playing space 16 indicating "Major Catastrophe" three times.

2. Lose all your insurance benefits and money. If you land on a playing space 16 where you have to pay for any expenses, but are not able to (you have depleted all your travel savings), you are out of the game.

Before the game begins, a banker must be chosen. The player who rolls the lowest number moves first. Each person starts off with $12,000 play money 26 travel savings.

The instructions in the twenty nine playing spaces 16 on the outer continuous path 12 going clockwise from the (Bon Voyage) start/stop playing space 42 are as follows:

1. Games
2. Roll again
3. Lost Baggage $1000 P.B. if insured
4. Limo service $200
5. Just traveling
6. Trip delay $500 lose one turn P. B. if insured
7. Long distance call $50
8. Lost passport $300 lose one turn
9. A or S
10. Just traveling
11. Games
12. Interpretation assistance $50 fee if insured
13. Robber steals $900
14. Car rental $200
15. Just traveling
16. Legal $100 P. B. if insured
17. Occupant adjustment $300
18. Free jet-ski rental
19. A or S
20. Just traveling
21. Games
22. Lost hotel keys $50
23. Free hotel upgrade
24. Shopping $400
25. Just traveling
26. Hired a private tour coordinator $200
27. Stolen credit card $400
28. Trip cancellation $500 P. B. if insured return to Bon Voyage!
29. A or S The instructions in twenty nine playing spaces 16 on the inner continuous path 14 going clockwise from the (Bon Voyage) start/stop playing space 42 are as follows:

1. Just traveling
2. Games
3. Need to send a message $50 free if insured
4. Sightseeing tour $100
5. Dinner and cruise $300
6. Just traveling
7. Jet-ski rental $100
8. Flat tire $50
9. Dinner and show $300
10. A or S
11. Just traveling
12. Games
13. Hotel upgrade $350
14. Developed pictures $50
15. Legal $1000 P. B. if insured
16. Just traveling
17. Free limo service
18. Your daughter wins bikini contest!!! $500
19. Interpretation assistance $50 free if insured
20. A or S
21. Just traveling
22. Games
23. Proceed to Bon Voyage!
24. Trip interruption $500 P. B. if insured lose one turn
25. Trip extension $500 lose one turn
26. Just traveling
27. Robber steals plane tickets $200
28. Shopping $400
29. Major catastrophe A or S=(Accident or sickness cards 28)—These are different medical situations which the player can possibly run into.

Legal=These are different legal situations in which the player can run into. Every time the player stops on the player space 16 labeled "Legal" he will have to pay a lawyer's fee of $1000 if not insured.

Major Catastrophe—There are three major catastrophes. The first time a player lands on the player's space 16 labeled "Major Catastrophe" he pays $2000 ( if not insured) for hospitalization as a result from a driving accident. The player also loses two turns. The second time a player lands on Major Catastrophe he pays $3000 (if not insured) for hospitalization as a result from fire (third degree burn) and lose three turns. The third time the player lands on Major Catastrophe he is finished and it is game over for him, as a result from a major surgery followed by recuperation at home.

Games—Whenever a player lands on a player's space 16 labeled "Games" he has an opportunity to win money. The number that he rolls times $100 is what he will win and receive from the bank. For example, if he rolls a five and a three on the dice 40, he will receive $800.

LIST OF REFERENCE NUMBERS 10 game board
12 outer continuous path on 10
14 inner continuous path on 10
16 playing spaces in 12 and 14
18 map of the world on 10
20 continent on 18
22 first type playing piece for 20
24 second type playing piece for 16

26 play money
28 accident/sickness card
30 travel record sheet
32 chance producing mechanism
34 token for 22
36 small airplane for 24
38 gaming piece for 32
40 die
42 start/stop playing space (Bon Voyage)

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation ca be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A travel assistance game which comprises:

a) a game board having two concentric continuous paths around its perimeter divided into consecutive playing spaces bearing instruction, some of which represent amounts to be paid and received by each player during the game;

b) a map of the world at the center of said game board, said map identifying by number and name six different continents, the numbers and names of the six different continents identified on said map of the world are 1 North America, 2 South America, 3 Europe, 4 Africa, 5 Asia and 6 Australia;

c) a plurality of first type playing pieces, with one for each player used to be placed onto each continent on said map during the game, each said first type playing piece is a token of a particular color;

d) a plurality of second type playing pieces, with one for each player used to be placed onto each playing space during the game, each said second type playing piece is a representation a small airplane of a particular color, each player uses said token of a particular color that matches with said small airplane of a particular color during the game;

e) play money of different denominations for distribution of part thereof to each player, said play money is in denominations of fifty dollars, one hundred dollars, five hundred dollars and one thousand dollars;

f) a plurality of accident/sickness cards, each to be picked by the players when their respective second type playing piece lands on a playing space bearing instructions to do so, said accident/sickness cards indicate different medical situations which the players can encounter and the amount of money that must be paid during the game;

g) a plurality of travel record sheets, one of which is used by each player, said travel record sheets are of three different types, in which, two are of two different insurance programs and the third is not for an insurance program, whereby each player can choose one type of said travel record sheet when they want to keep a record of their expenses during the game; and h) means for producing by chance a random output count to indicate the number of playing spaces to be moved by each said second type playing piece during the game.

2. A travel assistance game as recited in claim 1, wherein said chance producing means includes a plurality of individual gaming pieces, wherein the random output count always has a corresponding plurality of digits.

3. A travel assistance game as recited in claim 2, wherein said gaming pieces are dice.

4. A travel assistance game as recited in claim 3, wherein said dice are two in number.

5. A travel assistance game as recited in claim 4, wherein each continuous path on said game board includes twenty nine playing spaces and a start/stop playing spaced labeled "Bon Voyage!" to indicate one route thereabout, whereby each player must move their small airplane completely around the two continuous paths being two routes to complete their trip to each continent on said map of the world.

* * * * *